US009159474B2

(12) United States Patent
Ito

(10) Patent No.: US 9,159,474 B2
(45) Date of Patent: Oct. 13, 2015

(54) CONNECTING STRUCTURE AND CONNECTING METHOD OF INSULATED WIRES

(75) Inventor: Naoki Ito, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 207 days.

(21) Appl. No.: 13/807,762

(22) PCT Filed: Jul. 5, 2011

(86) PCT No.: PCT/JP2011/065392

§ 371 (c)(1),
(2), (4) Date: Dec. 31, 2012

(87) PCT Pub. No.: WO2012/005258

PCT Pub. Date: Jan. 12, 2012

(65) Prior Publication Data

US 2013/0092414 A1 Apr. 18, 2013

(30) Foreign Application Priority Data

Jul. 5, 2010 (JP) ..... 2010-153087

(51) Int. Cl.

| | |
|---|---|
| ***H01R 4/12*** | (2006.01) |
| ***H01B 13/00*** | (2006.01) |
| ***H01R 4/02*** | (2006.01) |

(Continued)

(52) U.S. Cl.

CPC ..... *H01B 13/00* (2013.01); *H01B 7/0009* (2013.01); *H01R 4/021* (2013.01); *H01R 4/12* (2013.01); *H01R 43/0207* (2013.01)

(58) Field of Classification Search

CPC ..... H01B 3/00
USPC ..... 174/74 R
See application file for complete search history.

(56) References Cited

U.S. PATENT DOCUMENTS

| | | | | |
|---|---|---|---|---|
| 1,751,405 | A * | 3/1930 | Herman | 439/883 |
| 2,643,366 | A * | 6/1953 | Berg | 439/878 |
| 5,446,241 | A | 8/1995 | Mackaness et al. | |

(Continued)

FOREIGN PATENT DOCUMENTS

| | | | |
|---|---|---|---|
| DE | 19956193 | A1 * | 6/2001 |
| JP | 60-175383 | A | 9/1985 |

(Continued)

OTHER PUBLICATIONS

Decision on Grant dated Mar. 27, 2014 issued by the Russian Patent Office in counterpart Russian Patent Application No. 2013104525.

(Continued)

*Primary Examiner* — William H Mayo, III
*Assistant Examiner* — Krystal Robinson
(74) *Attorney, Agent, or Firm* — Sughrue Mion, PLLC

(57) ABSTRACT

A connecting structure includes a sheathing connecting section in which sheathed sections of a plurality of electric wires, which are sections at both sides of exposed conductor sections, are bundled together in a state of being superimposed with each other; and a conductor connecting section in which the conductor sections of the plurality of electric wires are intertwined in a state of being folded back, and a section of the folded back conductor section remaining as a result of excluding a portion of the folded back conductor section are ultrasonically bonded in integration.

4 Claims, 8 Drawing Sheets

(51) Int. Cl.

| | |
|---|---|
| ***H01R 43/02*** | (2006.01) |
| ***H01B 7/00*** | (2006.01) |

(56) References Cited

U.S. PATENT DOCUMENTS

| | | | | |
|---|---|---|---|---|
| 5,493,069 | A * | 2/1996 | Conti | 174/94 R |
| 2004/0088857 | A1 * | 5/2004 | Fujimoto et al. | 29/871 |
| 2010/0096185 | A1 | 4/2010 | Otsuka et al. | |

FOREIGN PATENT DOCUMENTS

| | | | |
|---|---|---|---|
| JP | 5-500288 | A | 1/1993 |
| JP | 6-88092 | U | 12/1994 |
| JP | 07057790 | A | 3/1995 |
| JP | 2000-285981 | A | 10/2000 |
| JP | 2000285981 | A * | 10/2000 |
| JP | 2005-322544 | A | 11/2005 |
| JP | 2007-185706 | A | 7/2007 |
| SU | 1709452 | A1 | 1/1992 |
| WO | 2009/038099 | A1 | 3/2009 |

OTHER PUBLICATIONS

International Search Report (PCT/ISA/210) dated Aug. 2, 2011, issued by the International Searching Authority in International Application No. PCT/JP2011/065392.

Written Opinion (PCT/ISA/237) dated Aug. 2, 2011, issued by the International Searching Authority, in International Application No. PCT/JP2011/065392.

Office Action dated Aug. 15, 2014 issued by The State Intellectual Property Office of the People's Republic of China in counterpart Chinese application No. 201180033352.1.

Japanese Office Action dated Jul. 1, 2014, issued by the Japanese Patent Office in counterpart Japanese Application No. 2010-153087.

* cited by examiner

CONNECTING STRUCTURE AND CONNECTING METHOD OF INSULATED WIRES

TECHNICAL FIELD

The invention relates to a connecting structure and a connecting method of insulated wires, wherein a plurality of insulated wires are intertwined and electrically connected in integration.

BACKGROUND ART

When intertwining and electrically connecting insulated wires each having an insulated sheath, a variety of connecting methods have been adopted (for example, refer to Patent Documents 1 and 2). That is, the insulated sheaths of parts to be connected are stripped by a predetermined length, thereby exposing conductors. Then, the exposed conductors are soldered each other or are twisted together and connected by hand.

For example, as shown in FIG. 11, according to a connecting method disclosed in Patent Document 1, a rotary connector 100 that has an inlet 101, which has a cylindrical shape so as to have an enlargement, and two holes 102 having predetermined angles and a rotary shaft 103 is attached thereto is used to insert two cords into the holes and to rotate the rotary shaft. Thereby, the two cords are rotated at the same time, so that the two cords are intertwined and connected.

Also, as shown in FIG. 12, a connecting method disclosed in Patent Document 2 is a method of making an interlocking spiral twist connection between two wires 203, 204 and includes steps of positioning the wires 203, 204 in side by side relationship in cavity portions in both members 201, 202 and providing relative rotation between both members 201, 201 of a two-member connector. The cavity portions have such a configuration that the wires 203, 204 can be introduced into the cavity portions only in side by side relationship in the cavity portions when the wires are in a specific orientation relative to the cavity portions. The relative rotation of the two members 201, 202 causes the respective wires 203, 204 to be jammed against inner surfaces of the respective cavities. Also, a braking effect on the wires 203, 204 for controlling relative longitudinal movement between the wires under relative rotation and a converging force on the members 201, 202 are kept. Also, reference numerals 203A, 204A indicate accommodation parts in the connector.

Also, in recent years, an ultrasonic bonding has been adopted from a standpoint of a simple and secure operation. For example, according to a method shown in FIGS. 13(A) to 13(D), insulated sheaths of a plurality of insulated wires 301 to 304 are stripped to expose conductors 301A to 304A, which are then simply arranged in parallel (which also includes a parallel superimposed configuration). The exposed conductors arranged in parallel are subject to ultrasonic bonding, so that the conductors 301A to 304A are connected.

When the ultrasonic bonding is performed as described above, connection strength may be problematic in some cases. Specifically, a part of the conductors may be detached due to the insufficient connection strength.

Therefore, a connecting method of insulated wires as disclosed in Patent Document 3 has been suggested. That is, according to this connecting method of insulated wires, as shown in FIGS. 14(A), 14(B), 15(A) and 15(B), insulated sheaths of a plurality of insulated wires 401 to 404 are stripped by a predetermined length, respectively, thereby exposing conductors 401A to 404A. The exposed conductors

401A to 404A are twisted together in the same direction. Then, the twisted parts are welded and connected by ultrasonic bonding. Thereby, when electrically connecting the plurality of insulated wires 401 to 404, it is possible to secure the sufficient connection strength even though the conductors 401A to 404A are connected by the ultrasonic bonding.

TECHNICAL DOCUMENTS

Patent Documents

[Patent Document 1] JP-UM-A-6-88092
[Patent Document 2] JP-A-5-500288
[Patent Document 3] JP-A-2005-322544

SUMMARY OF THE INVENTION

Problems to be Solved by the Invention

However, according to the above connecting methods, for example, the method disclosed in Patent Document 1, when the cords are stiff or the number of cords is large, it is difficult to intertwine the cords. Also, according to the method of Patent Document 2, the connection is not made well with the intertwined wires. Also, it is necessary to prepare the connector in accordance with the number or diameters of the cords.

Also, according to the method disclosed in Patent Document 3, when intertwining the exposed conductors, it is necessary to hold the conductors with a jig and the like. Therefore, the conductors may be damaged, for example, may be scratched or disconnected at the conductor holder. Also, when the number of wires is large or when cross sections of the conductors are great, the damages to the conductors are increased due to the holder, so that the connection may not be made well.

The invention has been made to solve the above problems. An object of the invention is to provide a connecting structure and a connecting method of insulated wires, wherein damages to conductors are inhibited as much as possible when conductors of wires to be connected with each other are intertwined as a bundle, and damages to the conductors are minimized even when the number of wires to be connected is large or cross sections of the conductors are great.

Means for Solving the Problems

In order to achieve the above object, a connecting structure of insulated wires of the invention is characterized by a following configuration (1).

(1) A connecting structure of insulated wires wherein conductor sections of a plurality of electric wires, which are exposed as sheaths of the electric wires are partially removed, are intertwined and ultrasonically bonded in integration, the connecting structure comprising:

a sheathing connecting section in which sheathed sections of the plurality of electric wires are bundled together in a state that both sheathed sections interposing the exposed conductor sections therebetween are superimposed with each other, and a conductor connecting section in which the conductor sections of the respective electric wires are intertwined in a state that the exposed conductor sections are folded back and portions of the conductor sections except for portions of the folded back conductor sections are ultrasonically bonded in integration.

According to the connecting structure of insulated wires described in the above (1), it is possible to provide a connecting structure of insulated wires, wherein the damages to the conductors are inhibited as much as possible when the conductor sections of the respective electric wires to be connected with each other are intertwined as a bundle, and the damages to the conductors are minimized even though the number of wires to be connected is large or the cross sections of the conductors are great.

Also, a connecting method of insulated wires of the invention is characterized by following configurations (2) to (4).

(2) A connecting method of insulated wires, comprising the steps of:

removing a part of a sheath of each of a plurality of electric wires to expose a conductor section;

folding back the exposed conductor sections at a part and bundling sheathed sections of the respective electric wires in a state that both sheathed sections interposing the exposed conductor sections therebetween are superimposed with each other;

intertwining the folded back conductor sections of the respective electric wires; and ultrasonically bonding portions of the conductor sections in integration, except for portions of the folded back conductor sections.

(3) In the connecting method of insulated wires described in the above (2), in the intertwining step of the conductor sections, a rotation jig is inserted into parts of the folded back conductor sections of the respective electric wires and is then rotated to intertwine the conductor sections.

(4) In the connecting method of insulated wires described in the above (2) or (3), the method further comprises a step of processing the intertwined conductor sections into a predetermined shape by using a forming jig, wherein in the ultrasonic bonding step, portions of the conductor sections processed into the predetermined shape are ultrasonically bonded in integration, except for portions of the folded back conductor sections.

According to the connecting method of insulated wires described in the above (2), it is possible to provide a connecting method of insulated wires, wherein the damages to the conductors are inhibited as much as possible when the conductor sections of the respective electric wires to be connected with each other are intertwined as a bundle, and the damages to the conductors are minimized even though the number of wires to be connected is large or the cross sections of the conductors are great.

According to the connecting method of insulated wires described in the above (3), it is possible to easily intertwine the conductors by the rotation jig. According to the connecting method of insulated wires described in the above (4), it is possible to effectively perform the ultrasonic bonding.

Advantageous Effects of the Invention

According to the connecting structure of insulated wires of the invention, the damages to the conductors are inhibited as much as possible when the conductor sections of the respective electric wires to be connected with each other are intertwined as a bundle, and the damages to the conductors are minimized even though the number of wires to be connected is large or the cross sections of the conductors are great.

The invention has been briefly described. Also, the detailed configurations of the invention will be further clarified by reading through the illustrative embodiment that will be described below with reference to the accompanying drawings.

BRIEF DESCRIPTION OF THE DRAWINGS

FIGS. 2(A) and 2(B) show one wire that is used in the connecting structure of insulated wires according to the illustrative embodiment of the invention, wherein FIG. 2(A) shows the one wire that is used in the connecting structure of the insulated wires and FIG. 2(B) illustrates the one wire at a state that a sheath thereof is stripped.

FIGS. 3(A) and 3(B) show the other wire that is used in the connecting structure of insulated wires according to the illustrative embodiment of the invention, wherein FIG. 3(A) shows the other wire that is used in the connecting structure of the insulated wires and FIG. 3(B) illustrates the other wire at a state that a sheath thereof is stripped.

FIGS. 13(A) to 13(D) illustrate a method of intertwining wires according to another conventional technology, wherein FIGS. 13(A) to 13(D) show one process of the method, respectively.

FIGS. 14(A) and 14(B) illustrate a method of intertwining wires according to another conventional technology, wherein FIGS. 14(A) and 14(B) are a front view and a side view showing a state before the intertwining.

FIGS. 15(A) and 15(B) show a state during the intertwining in the method of intertwining wires shown in FIGS. 14(A) and 14(B), wherein FIGS. 15(A) and 15(B) are a front view and a side view

MODE FOR CARRYING OUT THE INVENTION

Hereinafter, illustrative embodiments of the invention will be described with reference to the accompanying drawings.

Figure 1:
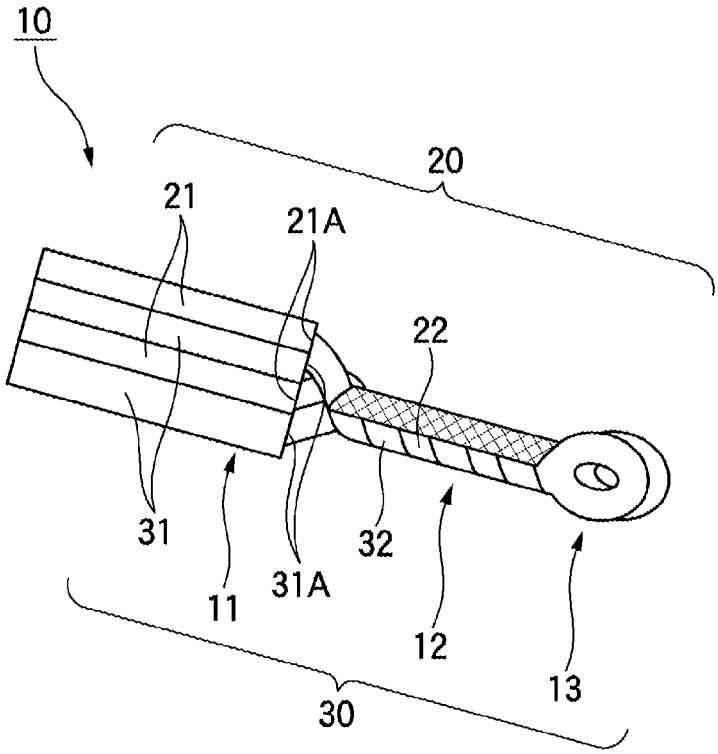
FIG. 1 is a perspective view showing a connecting structure of insulated wires to which a connecting method of insulted wires of an illustrative embodiment of the invention is applied.
Figure 2:
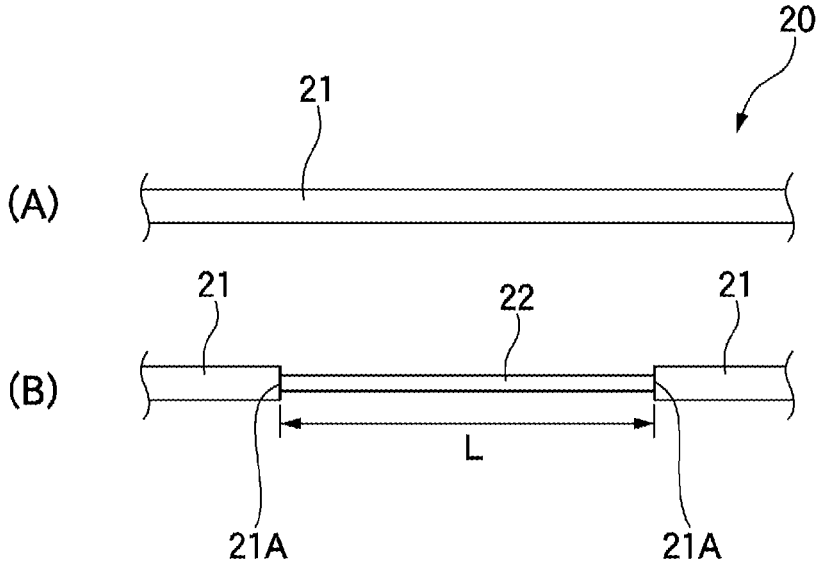
Figure 3:
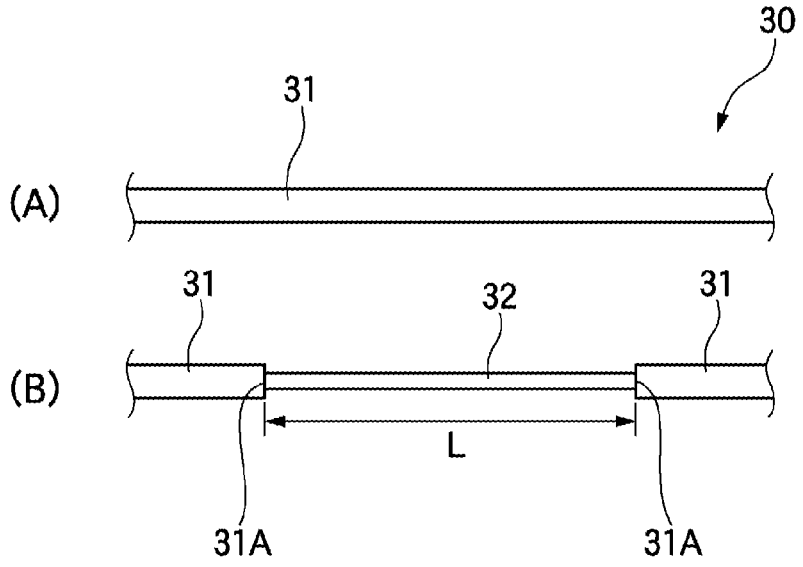

FIG. 1 shows a connecting structure 10 of insulated wires according to an illustrative embodiment of the invention. The connecting structure 10 of insulated wires has such a configuration that conductors 22, 32 (hereinafter, referred to as conductor sections. Refer to FIGS. 2(A), 2(B), 3(A) and 3(B)), which are exposed by stripping and removing sheaths positioned at central portions of a plurality of electric wires 20, 30 (two wires in this illustrative embodiment. However, the invention is not particularly limited to two wires) by a predetermined length, respectively, are intertwined and ultrasonically bonded in integration, and has a sheathing connecting section 11, a conductor connecting section 12 and a loop conductor section 13.

The sheathing connecting section 11 has such a configuration that respective sheathed sections 21, 31 of the plurality of electric wires 20, 30 are bundled together in a state that both sheathed sections 21 (31) of the sheath of the wire 20 (30) to be connected, which interpose the exposed conductor section 22 (32) between the sheathed sections 21, 31, are superimposed with each other.

The conductor connecting section 12 has such a configuration that the respective conductor sections 22, 32 are folded at folding points of the central portions thereof, the other wire 20 (30) is integrally intertwined with the folded back conductor section 22 (32) in a state that the exposed conductor sections 22, 32 are folded back, and portions of the conductor sections 22, 32 except for a portion (the loop conductor section 13 that will described later) of the folded back conductor sections 22, 32 are ultrasonically bonded in integration.

The loop conductor section 13 is configured by integrally forming a leading end of the conductor connecting section 12, which is formed by integrating the respective electric wires 20 (30), into a loop shape. Also, in this illustrative embodiment, the loop conductor section 13 remains. However, after the conductor connecting section 12 is formed, the loop conductor section 13 may be cut off because the conductor connecting section 12 is not unfastened.

In the below, a method of forming the connecting structure 10 of insulated wires according to this illustrative embodiment is described with reference to FIGS. 2(A) to 9.

First, the plurality of electric wires 20, 30 to be intertwined (two wires, in this illustrative embodiment) is prepared (refer to FIGS. 2(A) and 3(A)), the respective sheaths of the electric wires 20, 30 are stripped and removed by a predetermined length L, thereby exposing the conductor sections 22, 32 by the predetermined length L (refer to FIGS. 2(B) and 3(B)). Also, both edge portions of both sheathed sections 21, 31 of the respective electric wires, which interpose the conductor sections 22, 32 therebetween, are referred to as 'conductor-boundary edge portions 21A (31A).'

Then, the respective electric wires 20, 30 are folded back into two by using, as a reference point, a central portion L/2 of the respective conductor sections 22, 32 exposed by the predetermined length L as described above. Thereby, the conductor sections 22, 32 of the respective electric wires 20, 30 are formed into a loop shape (refer to FIG. 4). The 'loop shape' means that a gap is suppressed to the minimum, i.e., a slit-shaped opening S (refer to FIG. 4) is provided.

Figure 4:
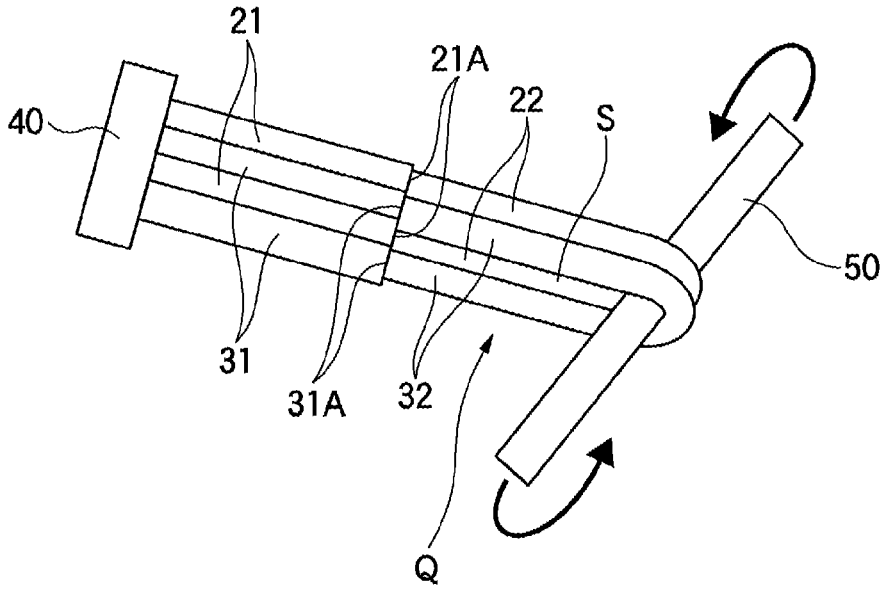
FIG. 4 shows one process of a connecting method of the connecting structure of the insulated wires.

As shown in FIG. 4, the sheathed sections 21, 31 of the respective bent electric wires 20, 30 are fixed and held in integration as a bundle by a holding jig 40. A penetration member 50 of a rotation jig is enabled to pass through the opening S of a folded section Q of the conductor sections 22, 32 of the respective electric wires 20, 30, the folded section is formed by folding back the conductor sections into the loop shape.

Figure 5:
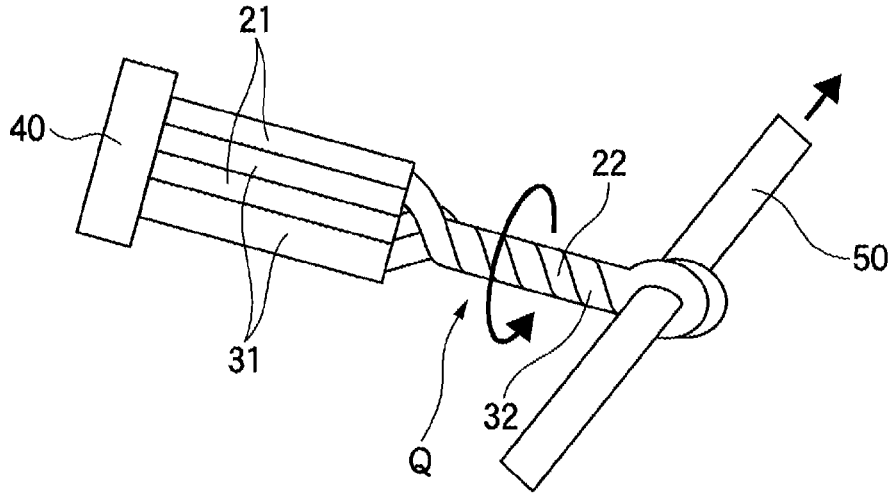
FIG. 5 shows one process of a connecting method of the connecting structure of the insulated wires.
Figure 6:
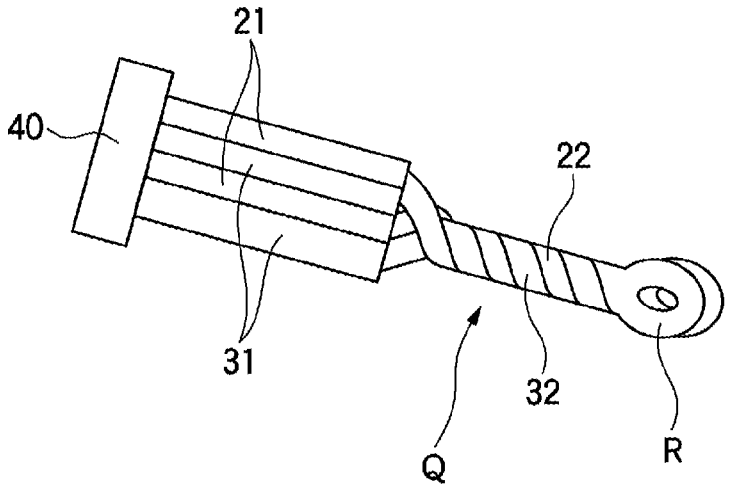
FIG. 6 shows one process of a connecting method of the connecting structure of the insulated wires.

Then, as shown in FIG. 4, the penetration member 50 is rotated by the rotation jig to thus twist the folded section Q of the conductor sections 22, 32 of the electric wires 20, 30 several times. Thereby, as shown in FIG. 5, the folded section Q, which is the conductor sections 22, 32 of both electric wires 20, 30, is intertwined in integration. By the rotation jig, it is possible to easily intertwine the conductor sections 22, 32.

By doing so, the folded section Q, which is the conductor sections 22, 32 of both electric wires 20, 30, is twisted and intertwined in integration, so that all areas except for a section leaving the penetration member 50 are intertwined. As a result, the opening S of the folded section Q is pushed to the leading end, so that the opening S is narrowed and the penetration member 50 of the rotation jig is pulled out from the opening S, thereby forming a ring section R (refer to FIG. 6).

Figure 7:
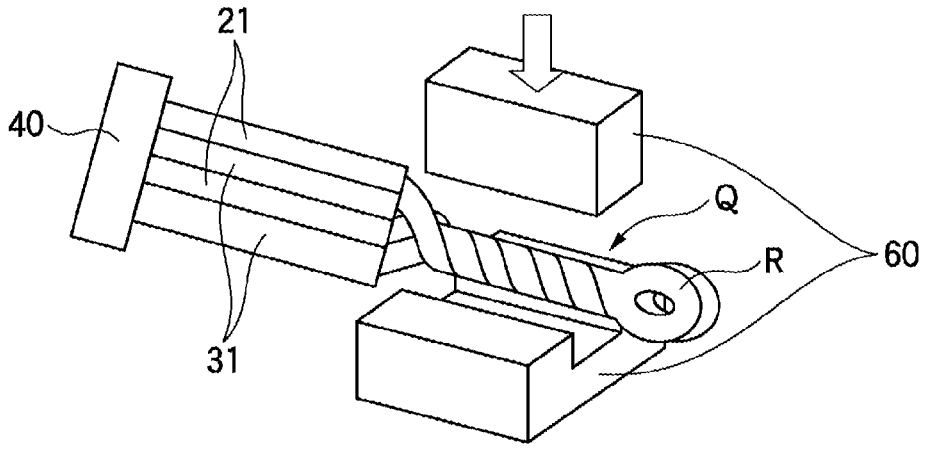
FIG. 7 shows one process of a connecting method of the connecting structure of the insulated wires.
Figure 8:
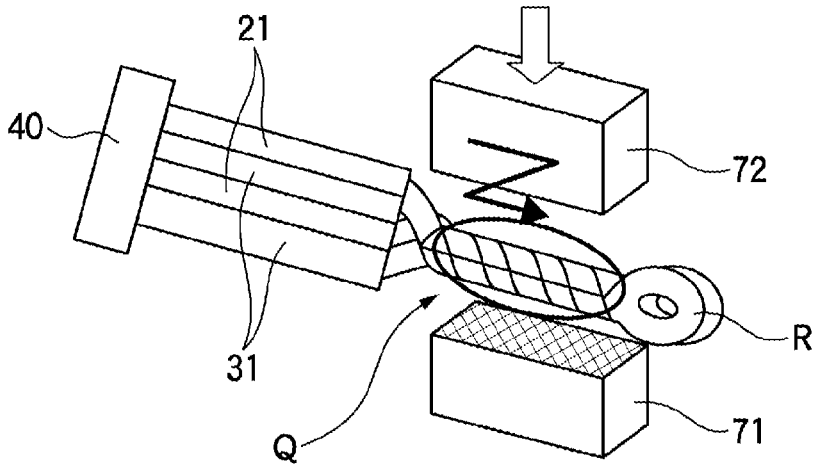
FIG. 8 shows one process of a connecting method of the connecting structure of the insulated wires.

Then, as shown in FIG. 7, the folded section Q, which is the conductor sections 22, 32 of both electric wires 20, 30, is pressurized into a predetermined shape by a pair of upper and lower forming jigs 60. This processing is not necessarily required. However, by the processing, it is possible to efficiently perform the ultrasonic bonding that will be described below.

As shown in FIG. 8, the intertwined folded section Q as described above is pressed (refer to a white arrow in FIG. 8), vibrated (refer to a solid arrow in FIG. 8) and is thus ultrasonically bonded by using an anvil 71 and a horn 72. Thereby, the conductor connecting section 12 is formed in which the conductor sections 22, 32 of the pair of wires are completely bonded in integration from the folded section Q.

Figure 9:
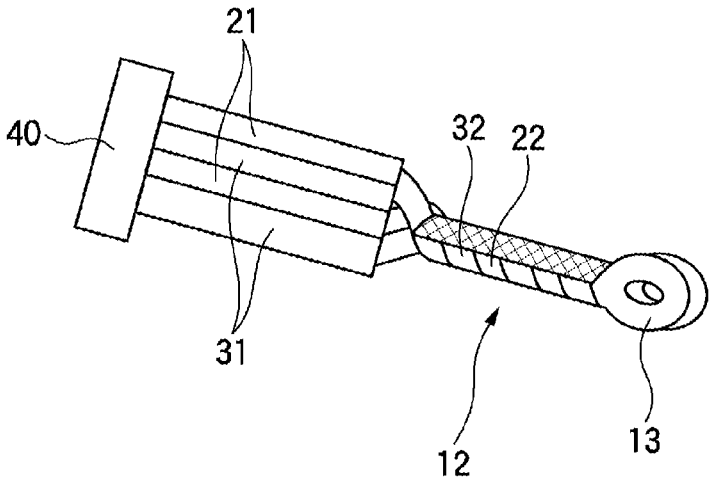
FIG. 9 shows one process of a connecting method of the connecting structure of the insulated wires.

Also, when the ring section R is left until the ultrasonic bonding is performed, i.e., after the conductor connecting section 12 is formed from the folded section Q by the ultrasonic bonding, the conductor sections 22, 32 are not naturally unfastened. Therefore, the ring section may be cut out. However, in this illustrative embodiment, the ring section remains as the loop conductor section 13, as shown in FIG. 9.

Also, after the connector connecting section 12 is formed by the ultrasonic bonding operation as described above, the conductor-boundary edges 21A (31A) of the sheathed sections 21, 31 of the respective electric wires 20, 30 are not naturally unfastened. Accordingly, it is possible to finally remove the holding jig 40 that incorporates the adjacency of the conductor-boundary edges 21A (31A) and integrally fixes and holds the same.

Figure 10:
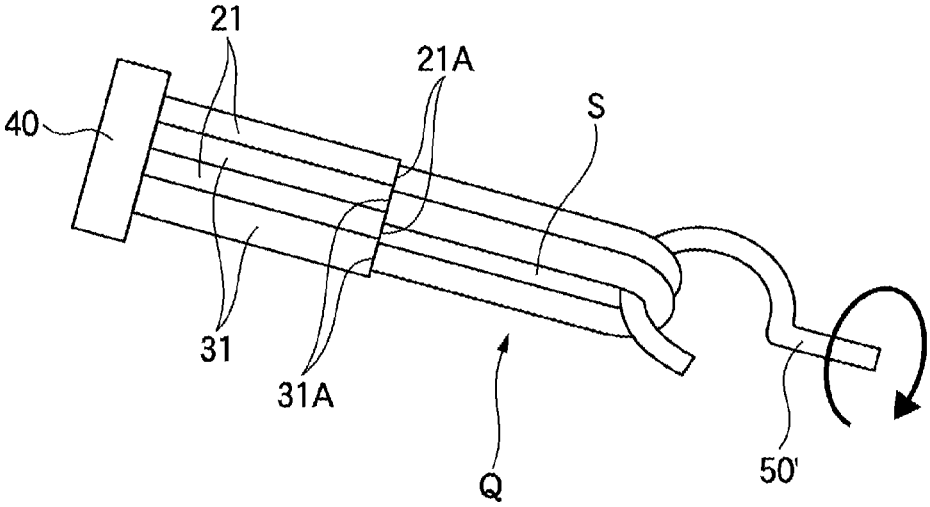
FIG. 10 shows an intertwining process that is performed using a separate rotation jig from a rotation jig shown in FIG. 4.
Figure 11:
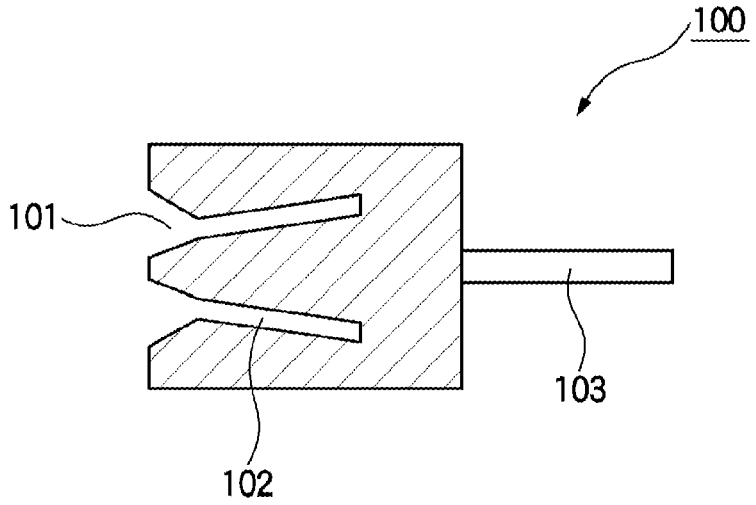
FIG.11 PRIOR ART
FIG. 11 is a sectional view showing a tool for electrically intertwining insulated wires according to a conventional technology.
Figure 12:
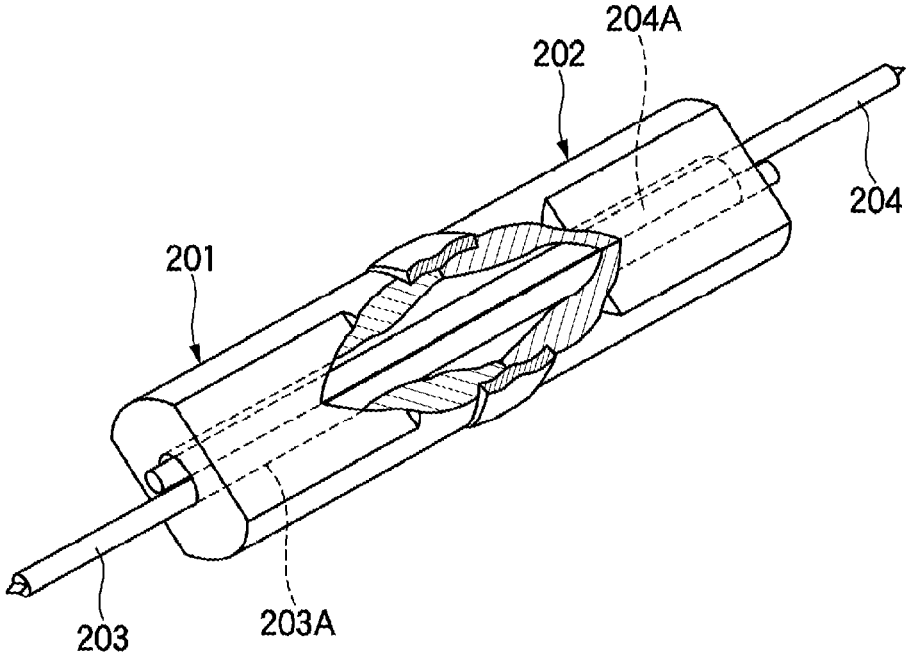
FIG.12 PRIOR ART
FIG. 12 is a perspective view showing a method of intertwining cables by using another connecting tool according to a conventional technology.
Figure 13:
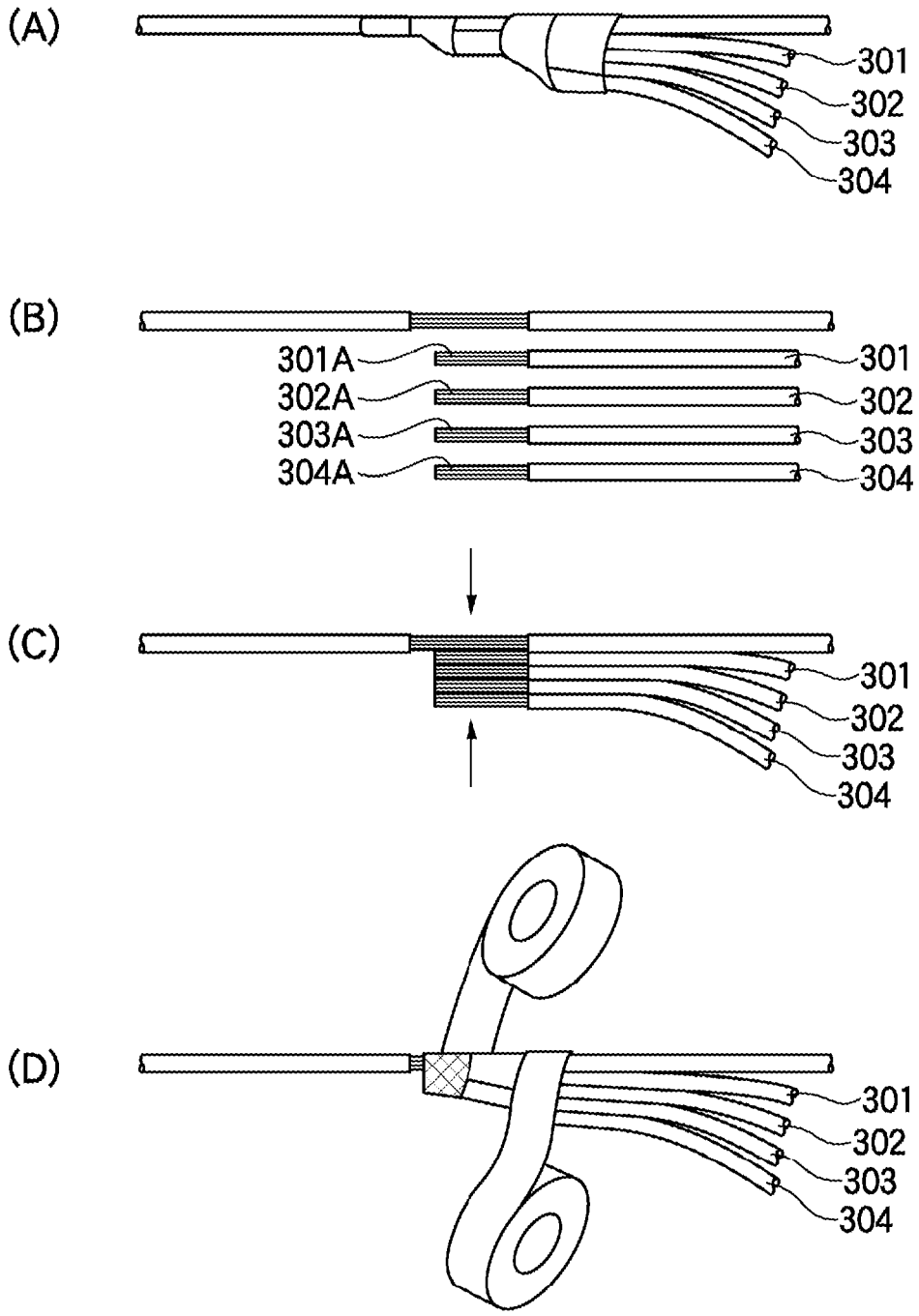
FIG. 13 PRIOR ART
Figure 14:
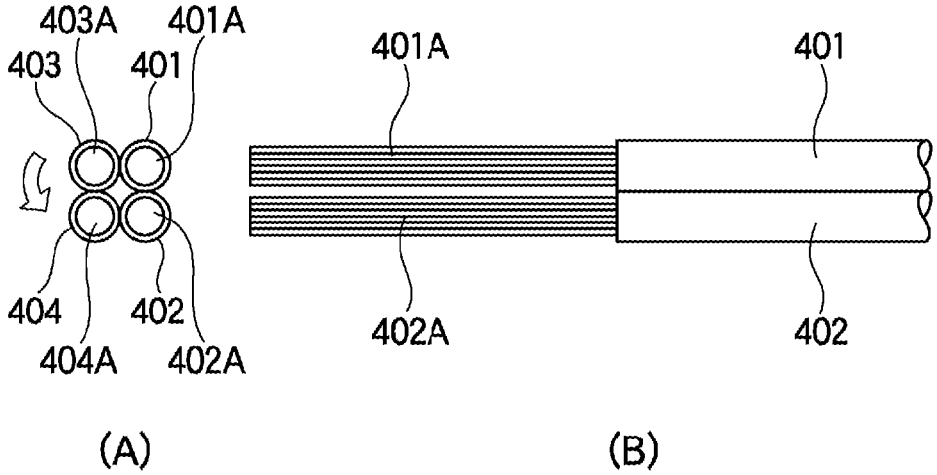
FIG.14 PRIOR ART
Figure 15:
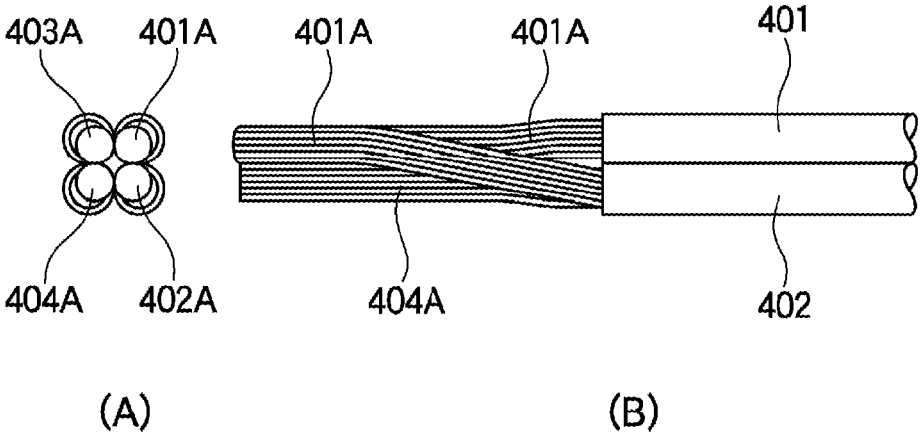
FIG.15 PRIOR ART

Also, in this illustrative embodiment, the folded section Q, which is the conductor sections 22, 32 of the respective electric wires 20, 30, is integrally twisted and intertwined to thus form the conductor connecting section 12 by using the holding jig 40 and the penetration member 50 of the rotation jig. However, as shown in FIG. 10, the folded section Q may be integrally twisted and intertwined by using a rotation jig 50' together with the holding jig 40.

Therefore, according to the method of forming the connecting structure 10 of insulated wires of this illustrative embodiment, the conductor sections are held by the holding jig. Hence, the conductor damages that are caused when the conductor sections 22, 32 are held are remarkably decreased. Thus, when forming the connecting structure 10 of the invention by the intertwining, it is possible to apply the connecting structure and method of the invention even though the number of the electric wires is large or the cross sections of the conductors are great.

Also, the invention is not limited to the above illustrative embodiment and can be implemented in various aspects without departing from the gist of the invention.

Although the invention has been specifically described with reference to the specific illustrative embodiments, a variety of changes and modifications can be made without departing from the spirit and scope of the invention.

This application is based on Japanese Patent Application No. 2010-153087 filed on Jul. 5, 2010, the disclosures of which are incorporated herein by reference.

Industrial Applicability

According to the connecting structure of insulated wires of the invention, the damages to the conductors are inhibited as much as possible when the conductor sections of the respective electric wires to be connected with each other are intertwined as a bundle, and the damages to the conductors are minimized even though the number of wires to be connected is large or the cross sections of the conductors are great.

Description of Reference Numerals and Signs

10: connecting structure of insulated wires
11: sheathing connecting section
12: conductor connecting section
13: loop conductor section
20, 30: wire
21, 31: sheathed section
21A, 31A: conductor-boundary edge portion
22, 32: conductor section
40: holding jig
50: penetration member of rotation jig
50': rotation jig
60: forming jig
71: anvil
72: horn
Q: folded section
R: ring section
S: opening

The invention claimed is:

1. A connecting structure of insulated wires wherein conductor sections of a plurality of electric wires, which are exposed as sheaths of the electric wires are partially removed, are intertwined and ultrasonically bonded in integration, the connecting structure comprising:

a sheathing connecting section in which sheathed sections of the plurality of electric wires are bundled together in a state that both sheathed sections interposing the exposed conductor sections therebetween are superimposed with each other, and a conductor connecting section in which the conductor sections of the plurality of electric wires are twistedly intertwined in a singular twist in a state that the exposed conductor sections are folded back, portions of the folded back conductor sections forming a loop conductor section, and portions of the conductor sections except for the loop conductor section are ultrasonically bonded in integration.

2. The connecting structure of insulated wires according to claim 1, wherein the portions of the conductor sections that are ultrasonically bonded comprises two portions of the conductor section of a wire of the plurality of electric wires being ultrasonically bonded to each other.

3. The connecting structure of insulated wires according to claim 1, wherein the portions of the conductor sections that are ultrasonically bonded are entirely twistedly intertwined.

4. A connecting structure of insulated wires wherein conductor sections of a plurality of electric wires, which are exposed as sheaths of the electric wires are partially removed, are intertwined and ultrasonically bonded in integration, the connecting structure comprising:

a sheathing connecting section in which sheathed sections of the plurality of electric wires are bundled together in a state that both sheathed sections interposing the exposed conductor sections therebetween are superimposed with each other, and a conductor connecting section in which the conductor sections of the respective electric wires are twistedly intertwined in a state that the exposed conductor sections are folded back, portions of the folded back conductor sections forming a loop conductor section, and portions of the conductor sections except for the loop conductor section are ultrasonically bonded in integration, wherein the portions of the conductor sections that are ultrasonically bonded are twistedly intertwined up to sheathed portions of the plurality of electric wires, the sheathed portions being bundled parallel to one another.

* * * * *